United States Patent [19]

King

[11] Patent Number: 5,062,553

[45] Date of Patent: Nov. 5, 1991

[54] CANTILEVER SPRING MOUNT FOR SLIDING GATE VALVE AND METHOD

[75] Inventor: Patrick D. King, Rantoul, Ill.

[73] Assignee: Flo-Con Systems, Inc., Champaign, Ill.

[21] Appl. No.: 539,582

[22] Filed: Jun. 18, 1990

Related U.S. Application Data

[63] Continuation-in-part of Ser. No. 494,587, Mar. 16, 1990.

[51] Int. Cl.[5] ..... B22D 41/08

[52] U.S. Cl. ..... 222/590; 222/600

[58] Field of Search ..... 222/600, 591, 592, 590; 267/41; 266/236, 45

[56] References Cited

U.S. PATENT DOCUMENTS 4,415,103 11/1983 Shapland et al. ..... 222/600
4,545,512 10/1985 Shapland et al. ..... 222/600
4,667,938 5/1987 King ..... 222/600

*Primary Examiner*—S. Kastler
*Attorney, Agent, or Firm*—Jack E. Dominik

[57] ABSTRACT

A method of providing a cantilever spring or a beam which is attached to the frame of a sliding gate valve is disclosed. The apparatus comprises a cantilever spring which is essentially flat and rectangular. A spring mount is provided to anchor the head end of the spring to permit the other end to flex against a load application member or the underneath side of the lower refractory member such as a tube holder and tube. The spring itself has a heel portion and a cantilever portion. At one end of the spring provision is made for a working face which engages the underneath portion of the lower refractory plate.

13 Claims, 2 Drawing Sheets

CANTILEVER SPRING MOUNT FOR SLIDING GATE VALVE AND METHOD

CROSS-REFERENCE TO RELATED APPLICATIONS

This application is a continuation-in-part of application Ser. No. 494,587 filed Mar. 16, 1990, and assigned to Flo-Con Systems, Inc., the assignee of this application.

FIELD OF THE INVENTION

The present invention relates to sliding gate valves, and primarily that type known as a three plate system which is exemplified in U.S. Pat. No. 4,415,103. Often these valves are referred to as "tundish valves" for use in teeming steel from a tundish and directing the flow of steel to the mold for a continuous caster.

SUMMARY OF THE PRIOR ART

Ever since U.S. Pat. No. Re. 27,237 disclosed a tundish valve utilizing rocker arms, which is also exemplified in more recent U.S. Pat. No. 4,415,103 the pressure for holding the refractory slide plates having a teeming orifice in opposed pressure relationship was supplied by spring loaded rocker arms. The springs are generally coil-type springs operating in compression against one end of the rocker arm. The rocker arm pivots about a rocker arm pivot pin and the opposite end of the rocker arm engages the underneath portion of a lower plate or tube holder. Because the coil spring is interior of the frame for the valve, it oftentimes requires cooling and, of course, takes up extra space in the frame. It is thus advantageous to eliminate the spring and shorten the frame dimensions of such a sliding gate valve, particularly in those locations where space is at a premium. Indeed, space is almost always at a premium for a tundish valve because it must be close to the continuous caster head of the mold, and yet accessible to replace the refractories.

SUMMARY OF THE INVENTION

The present invention is directed to the method of providing a cantilever spring or a beam which is attached to the frame of a sliding gate valve. The apparatus comprises a cantilever spring which has a bore in its mid-portion, and is essentially flat and rectangular. A spring mounting bolt is passed through the bore and secures the cantilever spring in face-to-face relationship with the frame with a cantilever portion extending centrally of the valve and proportioned to engage the underneath side of the lower refractory member such as a tube holder and tube. The spring itself has a heel portion and a cantilever portion. At the far end of the cantilever portion of the spring provision is made for a working face which engages the underneath portion of the tube holder.

One of the principal objects of the present invention is to provide a spring for a sliding gate valve to hold various of the refractory members in pressure face-to-face relationship which spring is one piece, and is so oriented that it will be sufficiently proximate to ambient that special cooling is not required.

Yet another object of the present invention is to provide a spring for use in a sliding gate valve which is cantilever, and mounted on a lower portion of the valve frame, to the end that no space is required for a coil spring and rocker arm mount such as evidenced in the prior art and which permits reducing the dimension across the valve along the transverse axis of the valve by an amount equal to or greater than the spring frame to provide additional clearance at the sides of the valve.

Still another object of the present invention is to provide a method for urging pressure face-to-face relationship between refractories in a sliding gate valve which is one piece, which has no moving parts, and which is cost effective in terms of parts manufactured, and time of assembly, when contrasted to the prior art rocker arm and coil spring.

BRIEF DESCRIPTION OF THE DRAWINGS

Further objects and advantages of the present invention will become apparent as the following description of an illustrative embodiment proceeds, taken in conjunction with the accompanying drawings, in which.

DESCRIPTION OF A PREFERRED EMBODIMENT

Figure 1:
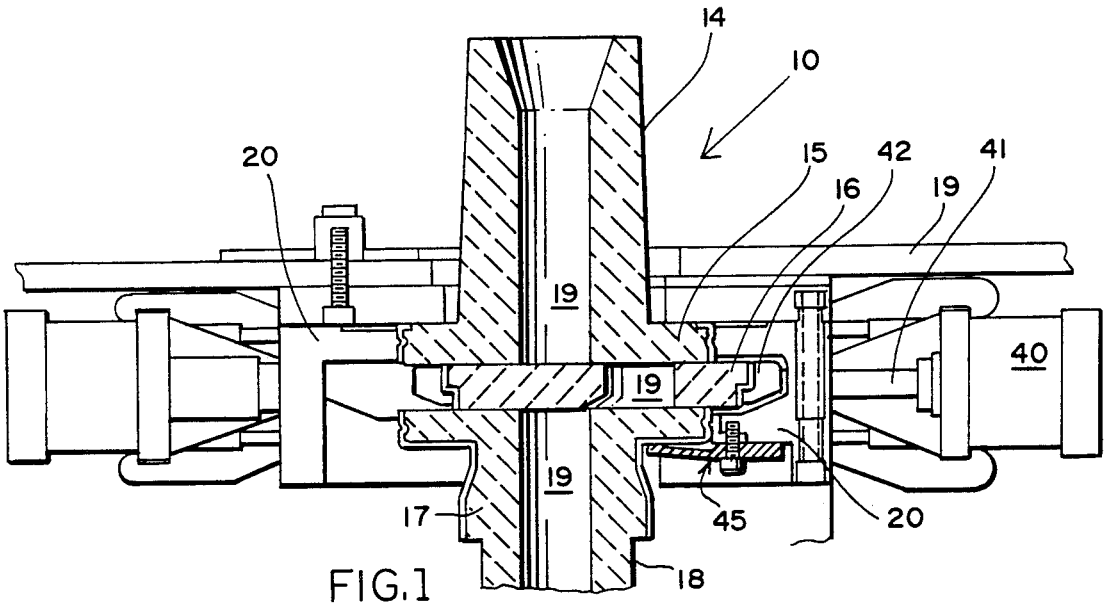
FIG. 1 is a transverse sectional view of a typical three plate sliding gate valve showing the cantilever spring in its position beneath the frame and urging the tube holder into pressure face-to-face relationship with the slide gate and upstream refractory members.

The subject matter of this invention will become apparent in the environment of a sliding gate valve 10 as shown in FIG. 1. The sliding gate valve 10 has a well block nozzle 14 which terminates at its lower portion in a top plate or stationary plate 15. The well block nozzle and top plate may be unitary. A slide gate 16 is positioned beneath the top plate or stationary plate 15, and there beneath a tube holder 17 and a downwardly extending tube 18 are mounted. Each of the stationary plate 15, slide gate 16, and tube holder 17 have a central teeming orifice 19 which is essentially the same diameter in all three members.

The slide plate or gate 16 is actuated into throttling condition as shown in FIG. 1 by means of a cylinder 40 having a shaft 41 extending therefrom to a regulating drive head 42 which engages the slide gate 16 and, as preselected, can translate the slide gate 16 into and out of register with the adjacent refractory members.

Figure 2:
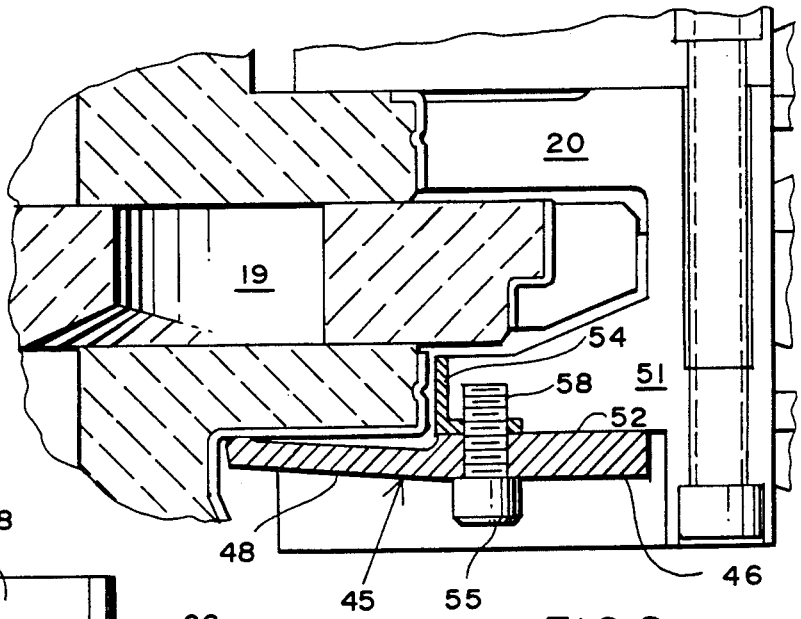
FIG. 2 is an enlarged view of the spring and its adjacent frame portion.

The cantilever spring 45 is shown in its valve environment in FIG. 1, but in enlarged form in FIG. 2. The cantilever spring 45 has a heel portion 46, and a cantilever portion 48. Particularly as shown in FIG. 2, the frame 20 is provided at a lower portion with a spring mount 51 having a spring pocket 52 formed at its lower portion. The end of the spring mount 51 is conformed to receive an L-shaped wear plate 54 which is mounted as a continuation of the spring pocket 52. A mounting bolt 55 as shown in FIG. 2 passes through the spring 45 and is secured to the spring mount 51 as the mounting bolt is threadedly engaged with the mounting bolt bore 58.

The method of the present invention relates to providing interface pressure engagement of refractory inserts in a sliding gate valve. Normally such a sliding gate valve includes the stationary plate 15, sliding gate 16, and tube holder 17 as illustrated in a valve environment beneath a vessel as shown in FIG. 1. A spring mount is formed on the valve identified as reference numeral 51 in FIG. 2. After forming the spring mount, a cantilever spring beam 45 is secured to the thus-formed spring mount. Most importantly, the method contemplates securing the refractory insert and working faces in pressure face-to-face relationship. Critical to the method, however, is that aspect of it which places the cantilever spring in ambient environment as distinguished from being inside the frame 20 of the valve assembly 10. By following this method, special cooling is not required for the cantilever spring 45. Further by following this method, the space heretofore needed for coil springs is eliminated as well as the necessity for cooling the same.

Figure 3:
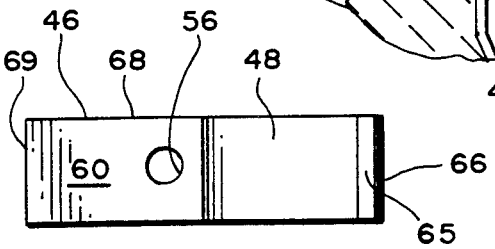
FIG. 3 is a plan view of the cantilever spring.
Figure 4:
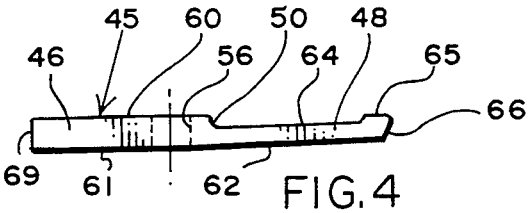
FIG. 4 is a side elevation of the cantilever spring shown in FIG. 3 to the same scale as that shown in FIG. 3.

More specific details of the cantilever spring 45 are shown in FIGS. 3 and 4. In FIG. 3 it will be seen that a mounting flat 60 is provided on the upper face of the heel portion 46 of the spring 45. The bore 56 is provided to receive the mounting bolt 55 at a point adjacent where the spring 45 transitions from its heel portion 46 to the cantilever portion 48. This transition occurs at a transition radius 50 which extends downwardly from the mounting flat 60 of the heel portion 46 of the cantilever spring 45.

Further as shown in FIG. 4, opposite the mounting flat 60 of the cantilever spring 45 is the bottom 61. A bottom riser 62 and parallel top riser 64 extend outwardly and define the main body of the cantilever portion 48. The same have opposed bottom riser face 62 and parallel top riser face 64. They terminate in a working face 65 which is flattened to, in pressure-engagement fashion, engage the lower face of the refractory which is being pressured into face-to-face relationship of the various refractory members. The front end 66 of the cantilever portion 48 runs across the width of the cantilever spring 45. Parallel sides 68 extend in a coextensive fashion across the length of the cantilever spring 45 between the cantilever member front end 66 and the end 69.

In a commercial embodiment, the angularity of the 24 risers 62, 64 is between 2° and 3° of the mounting face 60 and its bottom 61. The following dimensions are expressed in millimeters. With an entire length of 155.8, the center distance from the mounting bore 56 to the back end 69 is 60.0 and the remaining distance to the cantilever member front end 66 from the center of the bore 56 is 95.8. The spring itself is 44,800 wide. The distance from the radius 50 to the end 66, utilizing the same dimension scheme, is approximately 79.8. The thickness of the heel portion 46 is 6.00, with the thickness of the riser approximating 6.00. Desirably the entire spring is made out of high strength heat resistant ferrus based material.

Optionally the spring pocket 52 on the spring mount 51 of the valve frame 20 may angle upwardly approximately 2°. The anticipated deflection for the spring is approximately 2.50 millimeters. In the construction as shown, no other keepers or angle shims are required. The bore which receives the shank of the mounting bolt 55 is approximately 14.0.

First Alternative Embodiment

Figure 5:
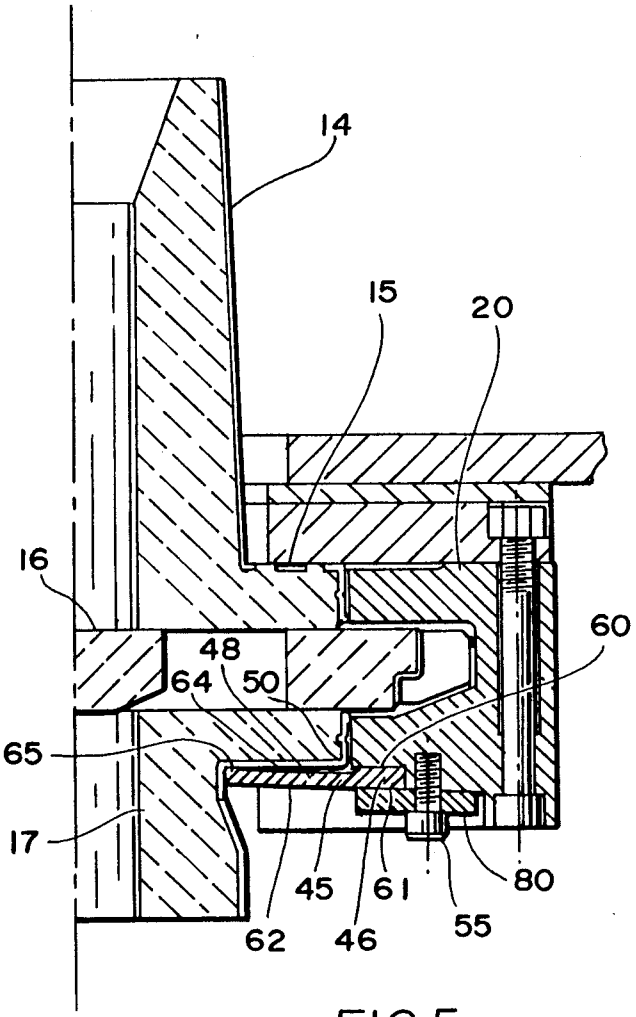
FIG. 5 is a transverse sectional view taken along the same elevation as FIGS. 1 and 2 illustrating a clamp-type alternative embodiment.

The first alternative embodiment is shown in FIG. 5 where common reference numerals are used with the first disclosed embodiment. There it will be seen that the well block nozzle 14 rides atop a top plate 15 beneath which there is a slide gate 16 secured by a tube holder 17 including a tube portion 18 and an orifice 19 mounted in a frame 20. The clamp-type spring 45 has a mount portion 46 and a cantilever portion 48 with a bottom riser 62 terminating in a working face 65 which engages the underneath surface of the tube holder 17. The mount portion 46 is secured by means of clamp 80 and anchored in place by the mounting bolt 55.

Second Alternative Embodiment

Figure 6:
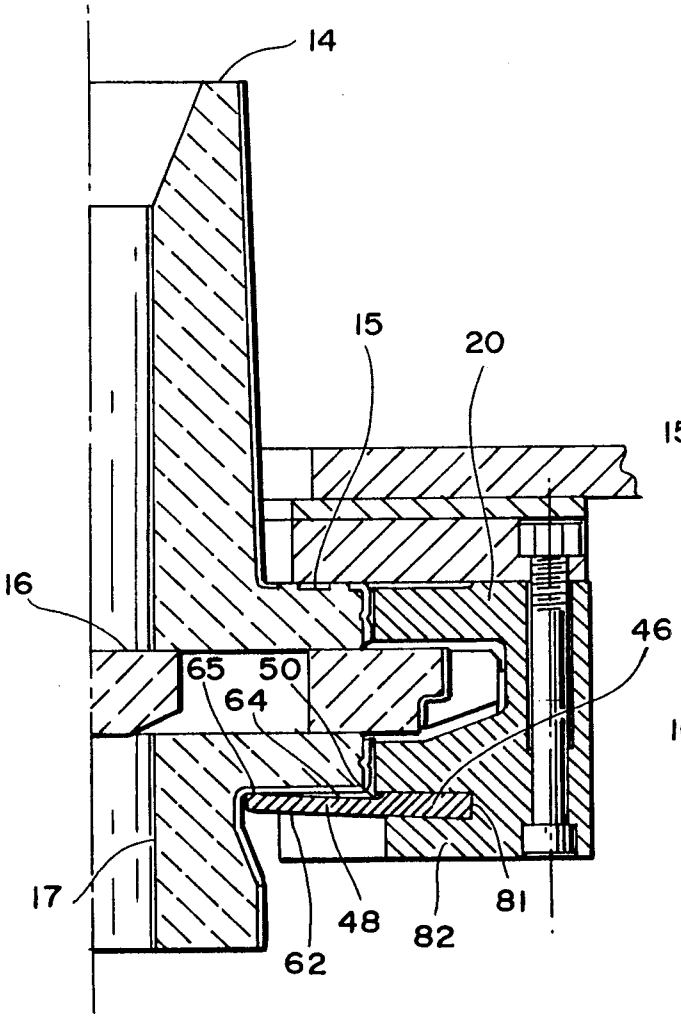
FIG. 6 is a further alternative view taken along the same vantage point as FIG. 5 illustrating a pocket-type mount for the cantilever spring.

The pocket embodiment of the cantilever spring 45 is shown in FIG. 6 where it will be seen that the environment remains the same as the first alternative embodiment except that there is a mounting recess 81 in the frame 20 which is opened up to receive in snug relationship the mount portion 46 of the spring 45. Otherwise, the cantilever portion 48 is substantially the same as that of the first and second embodiments, and terminating with a bottom riser 62 having a working face 65 to engage the underneath portion of the tube holder 17.

Third Alternative Embodiment

Figure 7:
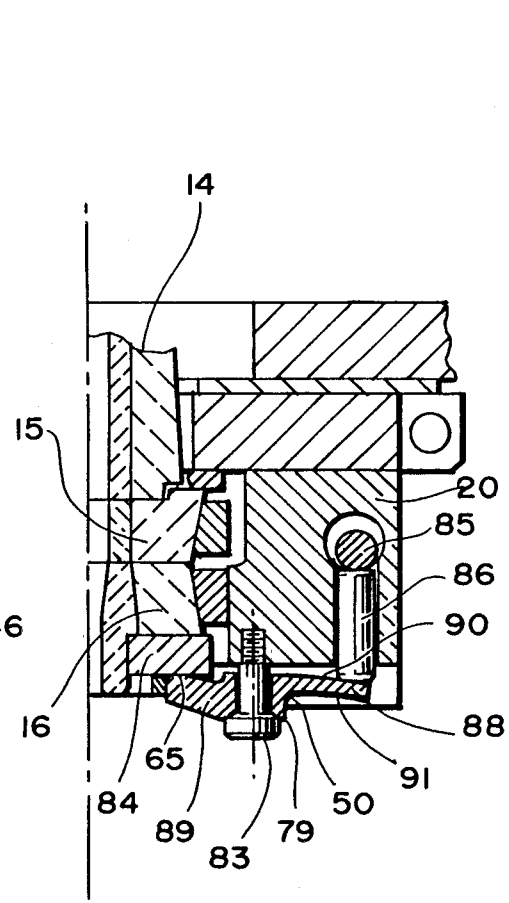
FIG. 7 is a further alternative embodiment showing a three point-type cantilever spring.

The third alternative embodiment of a three point-type cantilever spring is disclosed in FIG. 7. There it will be seen that the well block nozzle 14, top plate 15, and slide gate 16 remain essentially the same. The top plate 15 and slide gate 16 have there beneath a clamp bar 84 which is engaged by the working face 65 of the cantilever spring 79. The spring 79 includes a spring portion 88, and a load portion 89 which are pivotally secured by means of a central spherical mounting bolt 83 which threadedly engages the frame 20. The forces applied to the working face 65 by means of top face spring 90 being engaged to a cam follower 86 which is loaded downwardly (as shown) by means of the loading cam 85 while the spherical mounting bolt 83 acts as the fulcrum.

Summarizing all embodiments, what they have in common is a cantilever-type spring anchored in various fashion or pivoted which engages the lower portion of the refractory members being held in sandwiched relationship each to the other. The advantage of all embodiments is that the cantilever spring portion which flexes is exposed to ambient environment, even though the mount portion may be embedded in metal. This insures maximum flexing ability of the cantilever portion of the spring, minimized space occupation of the entire arrangement, and eliminates the need for forced cooling means.

It will be understood that various changes in the details, materials and arrangements of parts which have been herein described and illustrated in order to explain the nature of the invention, may be made by those skilled in the art within the principle and scope of the invention as expressed in the appended claims.

What is claimed is:

1. In a sliding gate valve, a cantilever spring for use in said sliding gate valve, said valve having a frame, said frame having cantilever spring mounting means, and a plurality of refractory members contained by said frame with each refractory member having an orifice for teeming steel when in alignment and controlling the flow of steel or shutting it off when misaligned comprising, said cantilever spring formed for mounting to said valve frame cantilever spring mounting means at a lower portion thereof, a body having a length at least twice the thickness, a heel portion of said spring body, mounting means provided for the heel portion, a cantilever portion of said spring body extending from the heel portion, said cantilever spring portion having a working face proportioned to engage an adjacent refractory member, and means for securing said cantilever spring to the valve.

2. In combination with the sliding gate valve of claim 1, a spring mount formed in the frame for said valve, a mounting member, and means for engaging the mounting member as it passes through the cantilever spring and on to the bore of the spring mount.

3. In the sliding gate valve of claim 1, in which, the mounting bore on the cantilever spring defines the transition between the heel portion and the cantilever portion of the spring.

4. In the sliding gate valve of claim 1, a radius causing the transition from the heel portion to the cantilever portion of said spring, said radius extending downwardly a distance less than the thickness of the heel portion of the cantilever spring.

5. In the sliding gate valve of claim 4, said radius terminating in a riser having parallel side portions and extending upwardly to a point where, upon terminating in the working face, the working face is substantially coplanar with the mounting flat face of the heel portion.

6. In the sliding gate valve of claim 1, said mounting means comprising a clamp, and means for securing the clamp to the valve frame in overlapping relation to the heel portion of the spring body.

7. In the sliding gate valve of claim 1, said mounting means comprising a pocket in the valve frame proportioned to nestingly receive the spring body heel.

8. In the sliding gate valve of claim 1, said mounting means comprising a pivotal bolt passing through the spring body in the heel portion and securing the heel to a refractory member, and means for loading the cantilever portion of the spring body.

9. The method for providing interface pressure engagement of refractory inserts in a sliding gate valve having a frame and a spring mount on the frame adjacent a refractory insert to be pressurized, comprising the steps of mounting a cantilever spring beam at one end thereof to the spring mount, said beam having a working face remote from said spring mount, and securing the refractory insert and working face in pressure relationship outside the valve frame in contact with ambient environment.

10. For use with a sliding gate valve for teeming metal from a vessel, said valve having a frame having a spring mount, said valve having multiple refractory inserts in pressure face-to-face contact and means for varying the position of said refractory inserts in pressure face-to-face contact, the improvement comprising a cantilever spring beam having a mounting portion, a cantilever portion, means for securing the mounting portion to the frame spring mount and a refractory insert working face remote from the mounting portion, said spring mount being exterior to the valve frame and proximate to the refractory insert to be pressurized by the working face, whereby the spring is cooled by the ambient environment and engages the refractory in the absence of additional working parts.

11. In the improvement of claim 7, said beam having a mounting portion and a cantilever portion, said cantilever portion having a thickness less than the mounting portion.

12. In the improvement of claim 7, said cantilever portion angling upwardly toward the working face.

13. In the improvement of claim 7, said working face being substantially in the plane of the mounting portion.

* * * * *